United States Patent [19]

Ono

[11] Patent Number: 4,642,857

[45] Date of Patent: Feb. 17, 1987

[54] BELT BUCKLE ASSEMBLY

[75] Inventor: Katsuyasu Ono, Fujisawa, Japan

[73] Assignee: NSK-Warner K. K., Tokyo, Japan

[21] Appl. No.: 543,842

[22] Filed: Oct. 20, 1983

[30] Foreign Application Priority Data

Oct. 28, 1982 [JP] Japan ..... 57-162291[U]

[51] Int. Cl.[4] ..... A44B 11/26

[52] U.S. Cl. ..... 24/637; 24/643

[58] Field of Search ..... 24/643, 644, 636, 637, 24/638

[56] References Cited

U.S. PATENT DOCUMENTS

| | | | |
|---|---|---|---|
| 3,256,576 | 6/1966 | Klove, Jr. et al. | 24/638 X |
| 3,921,262 | 11/1975 | Tanaka | 24/637 |
| 4,062,091 | 12/1977 | Holmberg | 24/644 X |
| 4,095,313 | 6/1978 | Piljay | 24/643 X |
| 4,377,888 | 3/1983 | Ikesue | 24/637 |
| 4,392,280 | 7/1983 | Gavagan | 24/637 |
| 4,393,555 | 7/1983 | Fohl | 24/643 |
| 4,393,557 | 7/1983 | Schmidt | 24/643 |

*Primary Examiner*—Peter A. Aschenbrenner

*Attorney, Agent, or Firm*—Shapiro and Shapiro

[57] ABSTRACT

A belt buckle assembly comprises a tongue plate, a cover having a slot through which the tongue plate is inserted, a base received in the cover, a latch member provided with a latch part for locking the tongue plate and supported by the base rotatably between a tongue plate locking position and a non-locking position, a biasing member which urges the latch member in the direction of the tongue plate locking position, and a push button member for moving the latch member to the non-locking position against the action of the biasing member. At least one of the latch member and the tongue plate is configured so that the latch plate, when twisted, cannot turn the latch member toward the non-locking position.

3 Claims, 7 Drawing Figures

BELT BUCKLE ASSEMBLY

BACKGROUND OF THE INVENTION

1. Field of the Invention

This invention relates to a belt buckle assembly.

2. Description of the Prior Art

Conventionally, in a belt buckle assembly in which a latch member is supported on a buckle base for rotation between a tongue plate locking position and a non-locking position, when a tongue plate which is locked by the latch member is twisted, the latch member contacts the tongue plate at the side of the rotational axis at which there is normal engagement between the tongue plate and a latch part of the latch member, and a moment is applied to the latch member by the tongue plate in the direction of the non-locking position, so that the the engagement of the tongue plate and the latch part is decreased or, in some cases, completely disappears. As a result thereof, the tongue plate may be easily disengaged from the latch member or is actually separated therefrom.

The occurrence of this problem must be prevented in such a device needed for high safety, such as a belt buckle assembly used in a seat belt device in a vehicle.

The position of the belt buckle assembly in a seat belt device or the physique of the occupant restrained by the seat belt sometimes results in such circumstances that the twist force as abovementioned to be applied to the tongue plate.

SUMMARY OF THE INVENTION

It is an object of the present invention to provide a belt buckle assembly in which even if the twist force is applied to a tongue plate, such a moment as moves a latch member in the non-locking position direction is not applied to the latch member and the undesirable possibility of the tongue plate being easily disengaged from the latch member or actually separating from the latch member is eliminated.

DESCRIPTION OF THE PREFERRED EMBODIMENTS

Figure 1:
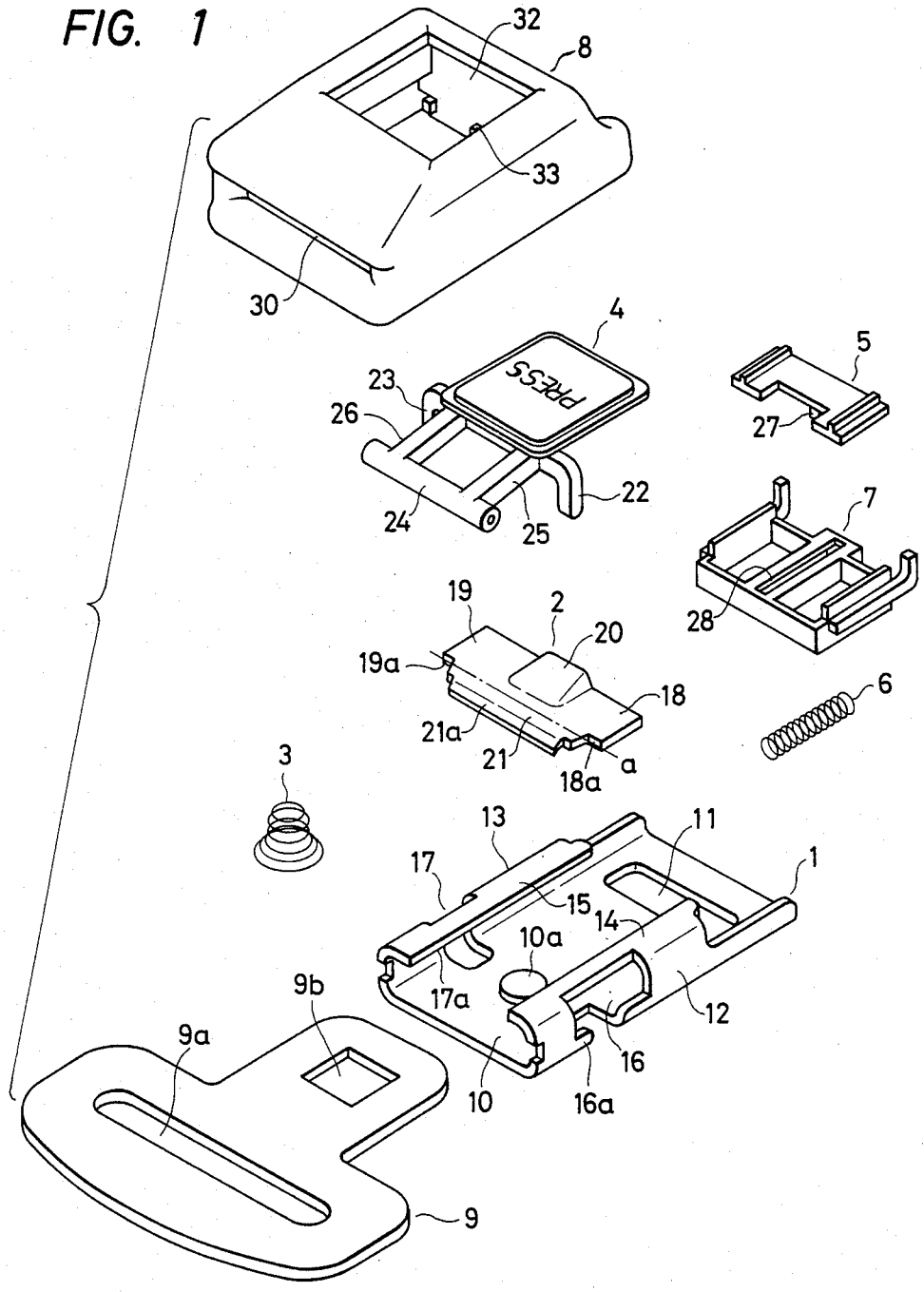
FIG. 1 shows a perspective exploded view of an embodiment according to the present invention.

In FIG. 1 showing a perspective exploded view, a belt buckle assembly comprises a buckle body including a base 1, a latch member 2, a conical coiled spring 3 for biasing the latch member, a push button 4, a slider assembly for ejecting a tongue plate and containing a slider 5, a coiled spring 6 and a case 7 for the coiled spring, and a buckle cover 8; and a tongue plate 9 provided with a relatively narrow slot 9*a* for receiving a webbing and an aperture 9*b* for connecting to the latch member.

The base 1 has a central plane portion 10 and a slot 11 for receiving unshown webbing fixed to the buckle, the slot being positioned in the vicinity of one end of the length-wise direction of the plane portion 10 (the term "length-wise direction" throughout the specification defines the direction of tongue plate's insertion and withdrawal).

Side wall portions 12 and 13 are formed in such a manner that they rise at about a right angle with the plane portion 10. These side wall portions 12 and 13 have bent portions 14 and 15, respectively at the top thereof, each of the bent portions being inwardly bent.

An opening 16 is formed in the vicinity of a forward end portion of the side wall portion 12 (ther term "forward" throughout the specification defines the portion of the buckle body at which the tongue plate is inserted), the bottom of the opening 16 extending somewhat in the plane portion 10.

In the side wall portion 13, an opening 17 is formed at a position opposite to the opening 16, the opening 17 has the shape of the opening 16 without its rear portion. The lengthwise width of the openings 16 and 17 is sufficiently large that lug portions 18 and 19 formed on both sides of the latch member 2 are loosely received in the openings 16, 17, respectively.

Forward frames 16*a* and 17*a* of the openings 16 and 17 rise at about a right angle with the plane portion 10 and provide supporting surfaces against edge surfaces 18*a* and 19*a* of the lug portions 18 and 19 of the latch member 2.

Figure 2:
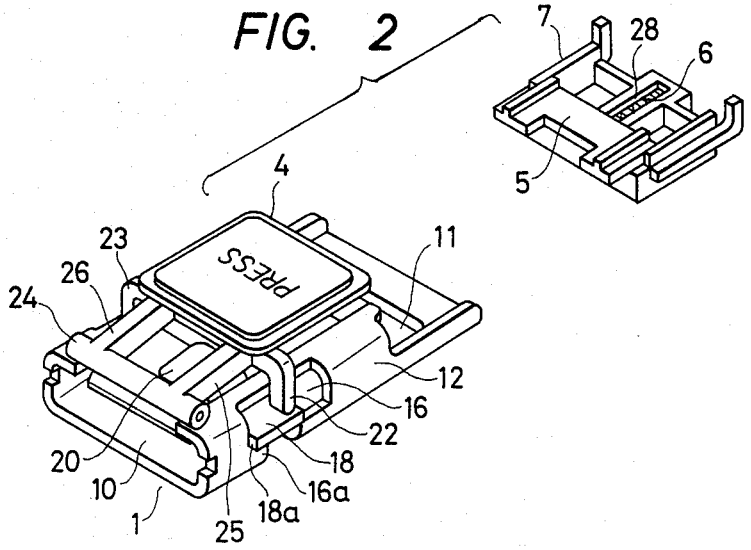
FIG. 2 shows a perspective view showing the embodiment prior to the assembling of a slider assembly.

The latch member 2 is of substantially rectangular shape and mounts on the plane portion 10 with the lug portions 18 and 19 being inserted in the openings 16 and 17 respectively and with the edge surfaces 18*a* and 19*a* of the lug portions 18 and 19 mounted on the forward frames 16*a* and 17*a* of the openings 16 and 17 respectively (see FIG. 2).

By the conical coiled spring 3 put around a circular projection 10*a* formed on the plane portion 10, the latch member 2 is usually urged upwards.

A latch part 20 is formed which is provided rearwards at the center portion of the latch member 2 and is projected upwards. A plane surface 21 having the latch part 20 thereon extends at both sides of pivotal axis a defined by a line connecting the edge surfaces 18*a* and 19*a* to each other. A portion 21*a* is formed at the front of the plane surface 21, the portion 21*a* being somewhat bent downwards for the purpose of increasing the rigidity of the latch member 2. The latch member 2 is so designed that with the latch member 2 set at a predetermined position, the rear portions of the lug portions 18 and 19 projecting to the outside of the openings 16 and 17 are in contact with leg portions 22 and 23 of the push button 4 (see FIG. 2).

With this construction, the tongue plate 9 is inserted between the latch member 2 and the bent portions 14 and 15 and the latch part 20 can be engaged with the aperture 9*b*. The push button 4 is rotatable about the axis of an axis part 24 which is positioned rotatably on unshown support part of the cover 8 provided forward of the inside surface thereof. The latch member 2 is operated by the rotation of the push button 4. A finger pressed portion of the push button 4 is connected to the axis part 24 by lengthwise extending bridge portions 25 and 26. The length of an arm from the axis part 24 to a part of the push button to which force is applied by a finger or fingers of the occupant is made long enough so that a light operation of the latch member 2 can be effected.

The slider 5 functions to eject the tongue plate 9 forward of the buckle body when the tongue plate is released by the push button 4. The slider 5 is provided with an L-shaped projection 27 which extends downwards and rearwards. This projection 27 is snugly fitted into a central lengthwise groove 28 of the coiled spring case 7. In the groove 28 a coiled spring 6 which extends lengthwise is received. By insertion of the projection 27 in the front edge portion of the coiled spring 6, the slider 5 is normally urged lengthwise and in the tongue plate insertion direction (see FIGS. 2 and 4). The thus assembled slider assembly is put on the back half of the plane portion 10 of the base 1. The cover 8 is in the shape of a box with the bottom thereof being open. The cover 8 is secured to the base 1 in such a manner that the cover 8 shields the base 1.

A rectangular slot 30 through which the tongue plate 9 can be inserted is formed on the front surface of the cover 8.

A bridge portion 31 (see FIGS. 3A and 3B) which extends to cover a trailing edge portion of the slot 11 is provided at the back of the cover 8. This bridge portion 31 functions to prevent the webbing passing through the slot 11 from being cut off. On the top surface of the cover 8, an aperture 32 for exposing a portion of the push button to be pressed by fingers of the occupant is formed.

Projections 33 are formed in the inner surface at the back of the cover 8 in order that the push button 4, with the axis part 24 thereof put on the support part forward in the inner surface of the cover 8, does not fall from the cover 8 when the buckle body is assembled.

The operation of the embodiment with the above-mentioned structure is illustrated in the following.

Figure 3A:
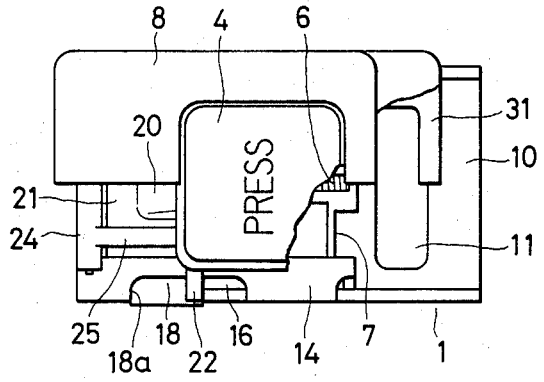
FIG. 3A shows a plan view of the embodiment prior to inserting a tongue plate and in which a cover is partly broken away.
Figure 3B:
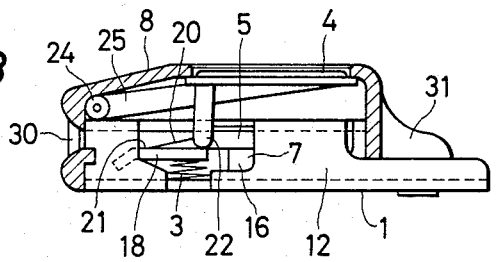
FIG. 3B shows a sectional side elevation of the embodiment prior to inserting a tongue plate.

In the condition where the tongue plate 9 has not been inserted yet through the slot 30, the latch member 2 and the push button 4 are stable at a position where they rotate up to the upper limit and the slider 5 is stable in a condition where the slider slides to a foremost position lengthwise of the stroke, as shown in FIGS. 3A and 3B.

When the tongue plate 9 is inserted through the slot 30 after the occupant is restrained by the seat belt, the end of the tongue plate 9 engages the latch part 20 of the latch member 2 and thereafter against the action of the spring 3 the latch part 20 is rotated downwards.

Figure 4:
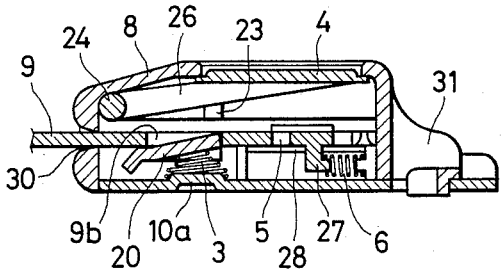
FIG. 4 shows a vertical longitudinal sectional view taken along the center line of FIG. 3A after insertion of a tongue plate.
Figure 5:
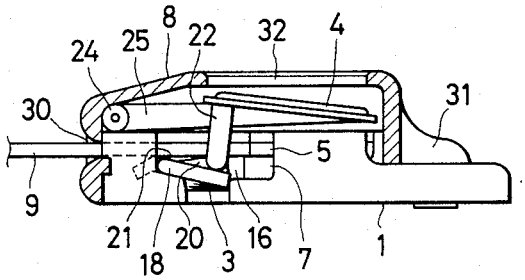
FIG. 5 shows a sectional side elevation view of the embodiment in which a tongue plate is about to be released.

When the tongue plate 9 is kept inserted and the latch part 20 is in mesh with the aperture **9*b* of the tongue plate 9, the latch member 2 is again rotated upwards by the action of the spring 3 to return to its original position, thus locking the tongue plate 9. At this time, withdrawal of the tongue plate 9 is impossible. At this time, the slider 5 is pressed by the end of the tongue plate 9 and slides rearwards against the action of the spring 6. In the condition where the tongue plate 9 is locked, the spring 6 is compressed. This condition is shown in FIG. 4. When the engagement of the latch member 2 with the tongue plate 9 is to be released and the push button 4 is depressed for the purpose of detaching the tongue plate 9 from the buckle body, the latch member 2 rotates downwards against the action of the spring 3 to terminate the locking action by the latch part 20 (see FIG. 5). Concurrently with this, the slider 5 is made to slide quickly in the forward direction by the spring 6 to thereby eject the tongue plate 9** forwards.

Figure 6:
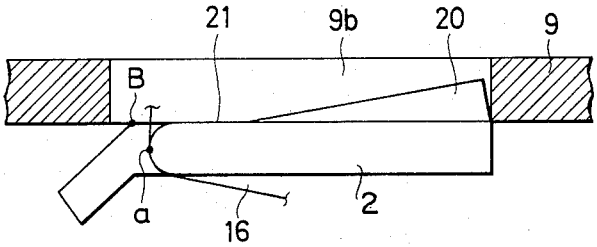
FIG. 6 shows an enlarged longitudinal sectional view for illustrating the tongue plate and the latch member in the engaged relation.

In the locking condition of FIGS. 4 and 6, when the tongue plate 9 is twisted, the tongue plate 9 is in contact with a point of B on the plane surface 21 forward of the axis of rotation a of the latch member 2 and a counter-clockwise moment about the axis a is applied to the latch member 2, as shown in FIG. 6. This moment acts in the direction tending to increase the engagement of the latch part 20 with the slot **9*b* of the tongue plate 9**. Therefore, the drawback of the conventional buckle assembly, that a moment in the non-locking position direction is applied to the latch member and that the tongue plate is easy disengaged or actually separated therefrom, is eliminated.

Even if the push button 4 is depressed somewhat, tending to release engagement of the tongue plate 9 with the latch member 2, so that the latch member 2 is rotated in the non-locking position direction, and even if such a rotating action of the latch member causes point B to be somewhat raised, contact of the tongue plate with the latch member as has caused the releasing of the tongue plate 9 never occurs, because in the usual locking position, where no twist force acts, the point B is away from the lower surface of the tongue plate.

In the embodiment as above stated, the plane surface 21 extends on both sides of the rotating center axis a so that the producing of such a moment as moves the latch member 2 in the non-locking position direction is prevented. However, the latch member 2 can be so designed that an end portion of such a plane surface accords with the rotating center axis, whereby no moment in any direction acts on the latch member.

For the purposes of the invention, the following manufacturing methods may be employed. To avoid producing a lappet by a press, the latch member may be formed by pressing in the direction opposed to the usual pressing direction; or the latch member may be formed by fine blanking.

Instead of shaping the latch member to attain the object of the invention, a proper surface (corresponding to surface 21) can be provided on the tongue plate. For example, the proper surface can be a projection surface which is in contact with the bent portion **21*a* of the latch member 2** in the embodiment as mentioned above. Specifically, in order that the moment in the non-locking position direction is not applied to the latch member, at least one of the tongue plate and the latch member is configured in such a manner that the engageable portion of the latch member with tongue plate is positioned at the axis of rotation of the latch member in the locking positiion or is disposed at the side of the rotational axis opposite to the latch part of the latch member.

According to the present invention, even if a twist force is applied to the tongue plate, such a moment as moves the latch member in the non-locking position direction is not applied to the latch member, so that a buckle assembly can be realized in which the tongue plate is not disengaged undesirably.

I claim:

1. A belt buckle assembly comprising a tongue plate and a buckle body, said buckle body including a cover having a slot through which the tongue plate is inserted, a base attached to the cover, a latch member supported on the base for pivotal movement between a locking position and a non-locking position about a pivotal axis extending transverse to a direction of insertion of said tongue plate through said slot, said latch member having latch means thereon located at one side of said pivotal axis, said latch means engaging said tongue plate inserted through said slot when said latch member is in said locking position and locking said tongue plate to said base, said latch means unlocking said tongue plate from said base when said latch member is in said non-locking position, biasing means supported in the buckle body and urging the latch member toward the locking position, and push-button means supported on the buckle body for moving the latch member to the non-locking position against the action of the biasing means, said tongue plate and said latch member having mutually engageable means for causing said tongue plate to engage said latch member at a side of said pivotal axis opposite to said one side when said tongue plate is locked to said base by said latch means and is twisted relative to said buckle body, said mutually engageable means applying a moment to said latch member about said pivotal axis in a direction tending to keep said latch member at said locking position.

2. The assembly according to claim 1, wherein said latch member has a plane surface extending on both of said sides of said pivotal axis, wherein said latch means is a projection from said surface at said one side of said axis, and wherein said mutually engageable means comprises a portion of said surface at said opposite side of said axis.

3. The assembly according to claim 1, wherein said latch member has a plane surface extending on both of said sides of said pivotal axis and includes a pair of spaced lugs for pivotally supporting said latch member on said base, said lugs extending in substantially the same plane as said plane surface, wherein said pivotal axis is defined by a line connecting aligned edges of said lugs, and wherein said mutually engageable means includes a portion of said plane surface at said opposite side of said pivotal axis.

* * * * *